US010202761B2

(12) United States Patent
Loyd

(10) Patent No.: US 10,202,761 B2
(45) Date of Patent: Feb. 12, 2019

(54) CURTAIN WALL SYSTEM, CORNER BRACKET FOR CURTAIN WALL SYSTEM, AND ASSOCIATED METHOD

(71) Applicant: Stephen N. Loyd Irrevocable Family Trust, Dallas, TX (US)

(72) Inventor: Stephen C. Loyd, Dallas, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 0 days.

(21) Appl. No.: 15/090,442

(22) Filed: Apr. 4, 2016

(65) Prior Publication Data

US 2017/0284091 A1 Oct. 5, 2017

(51) Int. Cl.

| | |
|---|---|
| ***E04H 1/00*** | (2006.01) |
| ***E04B 2/96*** | (2006.01) |
| ***E04B 2/94*** | (2006.01) |

(52) U.S. Cl.

CPC ..... *E04B 2/965* (2013.01); *E04B 2/94* (2013.01); *E04B 2/962* (2013.01); *E04B 2/967* (2013.01)

(58) Field of Classification Search

CPC . E04B 2/965; E04B 2/94; E04B 2/962; E04B 2/967

USPC ..... 52/235, 288.1

See application file for complete search history.

(56) References Cited

U.S. PATENT DOCUMENTS

| | | | | |
|---|---|---|---|---|
| 2,245,785 | A * | 6/1941 | Jentzer, Jr. ..... | E04F 13/0803 52/288.1 |
| 6,202,377 | B1 * | 3/2001 | Krieger ..... | E04F 13/0812 52/489.1 |
| 7,805,899 | B2 * | 10/2010 | Montgomery ..... | E04F 13/081 52/235 |
| 9,080,331 | B2 * | 7/2015 | Aboukhalil ..... | E04F 13/0816 |
| 2005/0246983 | A1 * | 11/2005 | Loyd ..... | E04F 13/0803 52/235 |
| 2008/0216444 | A1 * | 9/2008 | Loyd ..... | E04F 13/0803 52/742.16 |

* cited by examiner

*Primary Examiner* — Basil S Katcheves

(74) *Attorney, Agent, or Firm* — Slater Matsil, LLP

(57) ABSTRACT

In certain embodiments, a curtain wall system comprises first and second curtain wall member supporting apparatuses and a corner latching apparatus. The first and second supporting apparatuses each have a respective: vertically-disposed member; horizontally-disposed supporting member; and locking member coupled to the vertically-disposed member. The locking member is disposed beneath a lower surface of the horizontally-disposed supporting member. The corner latching apparatus has a corner shape and comprises a first horizontally-disposed latching arm oriented in a first direction and adapted to engage with the locking member of the first supporting apparatus. The corner latching apparatus comprises a second horizontally-disposed latching arm oriented in a second direction and a stabilizing resilient member disposed beneath a lower surface of each of the first and second horizontally-disposed latching arms, at least a portion of the stabilizing resilient member adapted to compress against an upper surface of a curtain wall member.

15 Claims, 7 Drawing Sheets

CURTAIN WALL SYSTEM, CORNER BRACKET FOR CURTAIN WALL SYSTEM, AND ASSOCIATED METHOD

TECHNICAL FIELD

The present disclosure relates generally to systems and methods of construction, and more particularly to a curtain wall system, a corner bracket for a curtain wall system, and an associated method.

BACKGROUND

In certain instances, it may be desirable to change the appearance of an exterior or interior wall. Furthermore, it may be desirable to provide an exterior covering for, or enhance the aesthetic appearance of, such a wall. The use of certain materials, such as those formed from ceramic, stone, or other suitable materials, may be desirable. In many instances, difficulties may be encountered in supporting and constructing the desired wall. Often, these difficulties may result in problems such as ill-fitting portions and an inefficient, time-consuming installation process that yields a less than desirable result.

SUMMARY

According to the present disclosure, disadvantages and problems associated with previous techniques for installing a curtain wall may be reduced or eliminated.

In certain embodiments, a curtain wall system comprises first and second curtain wall member supporting apparatuses and a corner latching apparatus. The first and second supporting apparatuses each have a respective: vertically-disposed member; horizontally-disposed supporting member; and locking member coupled to the vertically-disposed member. The locking member is disposed beneath a lower surface of the horizontally-disposed supporting member. The corner latching apparatus has a corner shape and comprises a first horizontally-disposed latching arm oriented in a first direction and adapted to engage with the locking member of the first supporting apparatus. The corner latching apparatus comprises a second horizontally-disposed latching arm oriented in a second direction and a stabilizing resilient member disposed beneath a lower surface of each of the first and second horizontally-disposed latching arms, at least a portion of the stabilizing resilient member adapted to compress against an upper surface of a curtain wall member.

In certain embodiments, a method is disclosed. The method comprises engaging a corner curtain wall member latching apparatus with a locking member of a first curtain wall member supporting apparatus, wherein the corner curtain wall member latching apparatus has a corner shape and comprises a first horizontally-disposed latching arm oriented in a first direction, a second horizontally-disposed latching arm oriented in a second direction, and a stabilizing resilient member, the stabilizing resilient member disposed beneath a lower surface of each of the first and second horizontally-disposed latching arms. The method further comprises compressing at least a portion of the stabilizing resilient member of the corner curtain wall member latching apparatus against an upper surface of a first curtain wall member.

Particular embodiments of the present disclosure may provide one or more technical advantages. For example, it may be desirable to provide support for a curtain wall member (e.g., stone) at or around the corner of a structure.

Certain embodiments of the present disclosure may provide a corner curtain wall member latching apparatus (e.g., a corner L-shaped bracket) that is adapted to engage with two horizontally-disposed supporting members, allowing an installer of the curtain wall system to affix one or more curtain wall members around a corner of a structure in an improved manner. The corner latching apparatus may reduce or eliminate the need for installers of a curtain wall system to construct a corner support member from one or more L-shaped brackets.

In another example, it may be desirable for a single installer of a curtain wall system to assemble curtain wall members (e.g., stone) around the corner of a structure without the assistance of other installers. Certain embodiments of the present disclosure may assist the installer in supporting a curtain wall member while the installer assembles an adjoining curtain wall member by providing a vertically-disposed retaining member extending downward from a lower surface of a corner curtain wall member latching apparatus (e.g., a corner L-shaped bracket) that partially engages with a notch (e.g., a kerf) in the curtain wall member (e.g., stone). The vertically-disposed retaining member may be used as an installation tool that allows the curtain wall member to rest in place while the installer erects the adjoining curtain wall member. Such an approach may allow the installation process to proceed more quickly and/or efficiently. Additionally, certain embodiments of the present disclosure may provide a stabilizing resilient member that is adapted to compress against an upper surface of a curtain wall member once the corner curtain wall member latching apparatus (e.g., a corner L-shaped bracket) is in place. The pressure exerted against the stabilizing resilient member may reduce or eliminate sagging of the corner curtain wall member latching apparatus (e.g., a corner L-shaped bracket) and may create a substantially even pressure along the upper surface of the latching apparatus, preventing the latching apparatus from twisting and/or warping.

It may be desirable to measure curtain wall members in the field during installation. In certain embodiments of the present disclosure, an upper surface of a corner curtain wall member latching apparatus (e.g., a corner L-shaped bracket) comprises a measuring scale that may assist an installer with field modifications. For example, the installer may measure how many inches to cut off the end of a curtain wall member (e.g., stone) so that it abuts an adjacent curtain wall member.

Certain embodiments of the present disclosure may provide some, all, or none of these advantages. Certain embodiments may provide one or more other technical advantages, one or more of which may be readily apparent to those skilled in the art from the figures, descriptions, and claims.

BRIEF DESCRIPTION OF THE DRAWINGS

To provide a more complete understanding of embodiments of the present disclosure and the features and advantages thereof, reference is made to the following description taken in conjunction with the accompanying drawings, in which.

DESCRIPTION OF EXAMPLE EMBODIMENTS

In many instances, it may be desirable to construct a facade along an exterior wall of a structure. A curtain wall may be particularly desirable in certain circumstances, in part because of the range of materials available for use in a curtain wall system, as well as the pleasing aesthetics of such a curtain wall system. Often, however, curtain wall members (e.g., stone) of the curtain wall system are required to wrap around the corners of a building, making installation a challenge. Difficulties may be encountered in supporting the curtain wall members at the corners of the building. One such difficulty includes modifying (e.g., cutting) the supporting members to form the corners, which takes additional time and materials. Further, modification of the supporting members may fail to achieve the desired appearance. For example, cutting the supporting members to form a corner supporting member may introduce sagging, warping, or twisting to the corner supporting member, which may negatively affect the appearance of the corner joint. At least certain embodiments of the present disclosure address these and potentially other deficiencies of existing systems and methods of constructing curtain walls.

Figure 1:
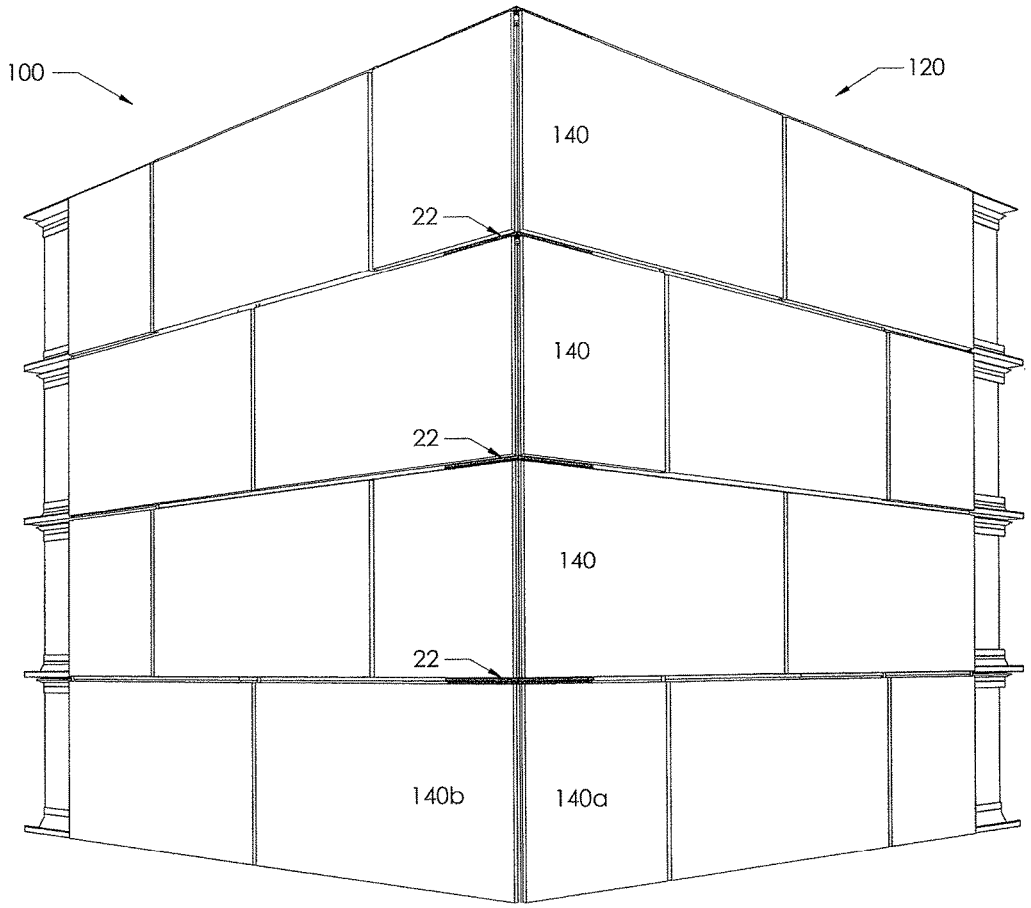
FIG. 1 illustrates an environmental view of an example of a curtain wall system installed in accordance with certain embodiments of the present disclosure.

FIG. 1 illustrates an environmental view of an example of curtain wall system 100 installed in accordance with certain embodiments of the present disclosure. In certain embodiments, curtain wall system 100 includes one or more curtain walls 120 formed of one or more curtain wall members 140. Curtain wall member 140 may be composed of ceramic, stone, glass, aluminum, wood, composite graphite, or any other suitable material or combination of materials. Curtain wall members 140 may have any suitable size and shape, according to particular needs. For example, curtain wall members 140*a* and 140*b* may comprise two separate rectangular-shaped members that abut at a corner. The abutting ends of curtain wall members 140*a* and 140*b* may be square or chamfered. As another example, curtain wall member 140 may comprise a single, L-shaped member that wraps the corner of a building.

As illustrated in the embodiment of FIG. 1, curtain wall system 100 includes corner curtain wall member latching apparatus 22. In the illustrated example, corner curtain wall member latching apparatus 22 is positioned at a corner of a structure in a gap a adjacent rows of curtain wall members 140. In certain embodiments, corner curtain wall member latching apparatus 22 provides support for one or more curtain wall members 140 at or around the corner of the structure.

In certain embodiments, corner curtain wall member latching apparatus 22 is adapted to engage with a support structure for curtain wall members 140, described below, allowing an installer of the curtain wall system 100 to affix one or more curtain wall members 140 around a corner of a structure. The installation of corner curtain wall member latching apparatus 22 may create a substantially even pressure between corner curtain wall member latching apparatus 22 and curtain wall members 140, which may reduce or eliminate sagging of the corner curtain wall member latching apparatus 22. Although FIG. 1 illustrates curtain wall system 100 including a particular number of corner curtain wall member latching apparatuses 22, the present disclosure contemplates curtain wall system 100 including any suitable number of corner curtain wall member latching apparatuses 22, according to particular needs. Additional details of various embodiments of corner curtain wall member latching apparatus 22 are described below.

Figure 2A:
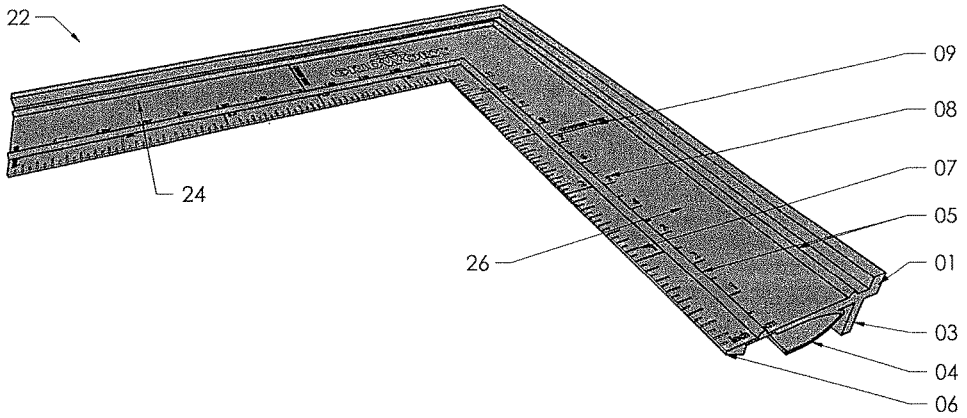
FIGS. 2A and 2B illustrate perspectives of an example corner curtain wall member latching apparatus of a curtain wall system in accordance with certain embodiments of the present disclosure.
Figure 2B:
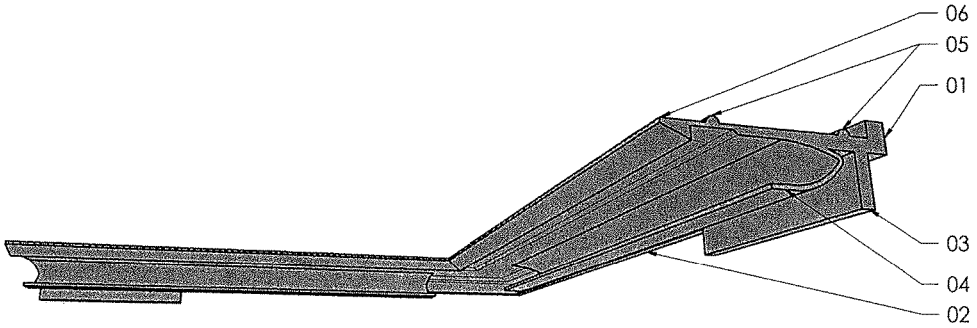

FIGS. 2A and 2B illustrate perspectives of an example corner curtain wall member latching apparatus 22 of curtain wall system 100 in accordance with certain embodiments of the present disclosure. In particular, FIG. 2A illustrates a top view of corner curtain wall member latching apparatus 22 and FIG. 2B illustrates a view of an underside of corner curtain wall member latching apparatus 22. For ease of description, corner curtain wall member latching apparatus 22 will be referred to as corner latching apparatus 22 or a corner bracket 22. In the illustrated embodiments of FIGS. 2A and 2B, corner latching apparatus 22 comprises latching arm 24, latching arm 26, locating member 1, locating member 2, retaining member 3, stabilizing resilient member 4, knobs 5, latch 6, Imperial scale 7, metric scale 8, and trim line 9.

As shown in FIGS. 2A and 2B, corner latching apparatus 22 has a corner shape. Although the present disclosure primarily described corner latching apparatus 22 as having a particular size and shape, the present disclosure contemplates corner latching apparatus 22 having any suitable size and shape, according to particular needs. As just one example, corner latching apparatus 22 may have a curved shape, if appropriate to accommodate a curved corner of a structure on which a curtain wall incorporating corner latching apparatus 22 is installed. Corner latching apparatus 22 may be made of any suitable combination of steel, aluminum, plastic, or any other suitable material.

In the illustrated embodiment, a proximal end of horizontally-disposed latching arm 24 is coupled to a proximal end of horizontally-disposed latching arm 26. In certain embodiments, horizontally-disposed latching arm 24 and horizontally-disposed latching arm 26 are fabricated to form a single, seamless corner. In alternative embodiments, horizontally-disposed latching arm 24 and horizontally-disposed latching arm 26 comprise separate elements that are joined at their respective proximal ends to form a corner. For example, a proximal end of horizontally-disposed latching arm 24 and a proximal end of horizontally-disposed latching arm 26 may be 45 degree angles that are welded to each other to form a 90 degree angle, wherein the weld forms a seam. In certain embodiments, the corner shape of corner latching apparatus 22 is substantially a right angle (i.e., 90 degrees). In alternative embodiments, horizontally-disposed latching arm 24 and horizontally-disposed latching arm 26 may couple to form an angle other than 90 degrees (e.g., 45 degrees or 60 degrees). Additionally or alternatively, corner latching apparatus 22 may have a curved or other shape, regardless of whether horizontally-disposed latching arm 24 and horizontally-disposed latching arm 26 form a single, seamless corner or comprise separate elements joined to form a corner.

Vertically-disposed locating member 1 extends from an end of horizontally-disposed latching arms 24 and 26. For example, vertically-disposed locating member 1, as shown in FIG. 2A, extends upward from an end of horizontally-disposed latching arms 24 and 26. Upward-extending vertically-disposed locating member 1 may be located partially or continuously along the extents of horizontally-disposed latching arms 24 and 26. For example, upward-extending vertically-disposed locating member 1 may be located continuously along an outer edge of horizontally-disposed latching arms 24 and 26. Upward-extending vertically-disposed locating member 1 may connect seamlessly to horizontally-disposed latching arms 24 and 26. Alternatively, the connection between upward-extending vertically-disposed locating member 1 and horizontally-disposed latching arms 24 and 26 may comprise a seam. For example, upward-extending vertically-disposed locating member 1 may be fabricated as a separate piece that is adapted to be welded to horizontally-disposed latching arms 24 and 26, creating a seam at the weld.

Vertically-disposed locating member 2 extends from a surface of horizontally-disposed latching arms 24 and 26. For example, as shown in FIG. 2B, vertically-disposed locating member 2 extends downward from a lower surface of horizontally-disposed latching arms 24 and 26. Downward-extending vertically-disposed locating member 2 may be located partially or continuously along the extents of horizontally disposed latching arms 24 and 26. For example, downward-extending vertically-disposed locating member 2 may be located continuously along a lower surface of horizontally-disposed latching arms 24 and 26. As shown in the illustrated embodiment, downward-extending vertically-disposed locating member 2 is located near an edge of horizontally disposed latching arms 24 and 26. In certain embodiments, downward-extending vertically-disposed locating member 2 connects seamlessly to horizontally-disposed latching arms 24 and 26. Alternatively, the connection between downward-extending vertically-disposed locating member 2 and horizontally-disposed latching arms 24 and 26 in certain embodiments may comprise a seam. For example, downward-extending vertically-disposed locating member 2 may be fabricated as a separate piece that is adapted to be welded to horizontally-disposed latching arms 24 and 26, creating a seam at the weld.

Corner latching apparatus 22 may include a vertically-disposed retaining member 3. As shown in FIGS. 2A and 2B, vertically-disposed retaining member 3 extends downward from downward-extending vertically-disposed locating member 2. Downward-extending vertically-disposed retaining member 3 may be located partially or continuously along the extents of horizontally disposed latching arms 24 and 26. As shown in the illustrated embodiment of FIG. 2B, downward-extending vertically-disposed retaining member 3 is located along a portion of each horizontally-disposed latching arm 24 and 26. For example, downward-extending vertically-disposed retaining member 3 may begin at the distal end of horizontally-disposed latching arm 24 and run two inches in length toward the proximal end of horizontally-disposed latching arm 24. Similarly, downward-extending vertically-disposed retaining member 3 may begin at the distal end of horizontally-disposed latching arm 26 and run two inches in length toward the proximal end of horizontally-disposed latching arm 26. Although downward-extending vertically-disposed retaining member 3 is described as having a particular length, the present disclosure contemplates downward-extending vertically-disposed retaining member 3 having any suitable length, according to particular needs.

In certain embodiments, downward-extending vertically-disposed retaining member 3 connects seamlessly to downward-extending vertically-disposed locating member 2. Alternatively, the connection between downward-extending vertically-disposed retaining member 3 and downward-extending vertically-disposed locating member 2 may comprise a seam. In some embodiments, downward-extending vertically-disposed retaining member 3 is adapted to at least partially engage with a notch in curtain wall member 140.

Stabilizing resilient member 4, as shown in the illustrated embodiments of FIGS. 2A and 2B, is disposed beneath a lower surface of horizontally-disposed latching arms 24 and 26. In certain embodiments, stabilizing resilient member 4 may be disposed beneath either the lower surface of horizontally disposed latching arm 24 or the lower of surface horizontally disposed latching arm 26. Stabilizing resilient member 4 may have any suitable size and shape, according to particular needs. In the illustrated embodiment, the shape of stabilizing resilient member 4 resembles a hook.

Stabilizing resilient member 4 may be adapted to compress against an upper surface of curtain wall member 140. For example, stabilizing resilient member 4 may operate in a spring-like manner when corner latching apparatus 22 is positioned between a curtain wall member supporting apparatus, described in greater detail below, and a curtain wall member. In certain embodiments, stabilizing resilient member 4 compresses against more than one curtain wall member 140. For example, the portion of stabilizing resilient member 4 disposed beneath a lower surface of horizontally disposed latching arm 24 may compress against curtain wall member 140*a* and the portion of stabilizing resilient member 4 disposed beneath a lower surface of horizontally disposed latching arm 26 may compress against curtain wall member 140*b*. Alternatively, stabilizing resilient member 4 may be adapted to compress against a single L-shaped curtain wall member.

Corner latching apparatus 22 may include one or more knobs 5 along a surface of horizontally-disposed latching arms 24 and 26. As shown in FIGS. 2A and 2B, knobs 5 are disposed along an upper surface of horizontally-disposed latching arms 24 and 26. Knobs 5 may have any suitable size and shape, according to particular needs. In the illustrated embodiments of FIGS. 2A and 2B, knobs 5 are shaped to resemble hemispheres. Knobs 5 may advantageously help maintain proper alignment between horizontally-disposed latching arms 24 and 26 of corner latching apparatus 22 and adjacent curtain wall members, curtain wall member supporting apparatuses, and/or other structures of curtain wall system 100.

In certain embodiments, corner latching apparatus 22 comprises connection mechanism 6. As illustrated in the embodiments of FIGS. 2A and 2B, connection mechanism 6 is positioned along an inner edge of horizontally-disposed latching arms 24 and 26 of corner latching apparatus 22. In alternative embodiments, connection mechanism 6 may be positioned along an inner edge of only one horizontally disposed latching arm (i.e., horizontally disposed latching arm 24 or horizontally disposed latching arm 26). Connection mechanism 6 may extend along an entire extent of one or more horizontally-disposed latching arms 24 and 26. Alternatively, connection mechanism 6 may extend along a portion of one or more horizontally-disposed latching arms 24 and 26. In certain embodiments, stabilizing resilient member 4 is located between connection mechanism 6 and downward-extending vertically-disposed locating member 2. Connection mechanism 6 of corner latching apparatus 22 may have any suitable size and shape, according to particular needs. In the illustrated embodiment of FIGS. 2A and 2B, connection mechanism 6 is a latch adapted to engage with adjacent curtain wall supporting members, as described in greater detail below.

Corner latching apparatus 22 may comprise one or more measuring scales (e.g., a ruler). As shown in the illustrated embodiment of FIG. 2A, an upper surface of corner latching apparatus 22 may comprise markings for a U.S. Imperial scale 7 and a metric scale 8. U.S. Imperial scale 7 and metric scale 8 may assist the curtain wall installers with field modifications of the corner latching apparatus 22. For example, an installer of curtain wall system 100 may use U.S. Imperial scale 7 to measure the number of inches of curtain wall member 140 the installer may cut so that curtain wall member 140 fits a corner of a building. As another example, an installer of curtain wall system 100 may use metric scale 8 to measure the number of centimeters of corner latching apparatus 22 the installer may trim off for modification purposes. Although example corner latching apparatus 22 is primarily illustrated and described as including both a U.S. imperial scale and a metric scale, the present disclosure contemplates corner latching apparatus 22 including any suitable combination of U.S. Imperial scale 7, metric scale 8, or any other suitable measuring scale. Alternatively, the present disclosure contemplates corner latching apparatus 22 including no measuring scale.

In certain embodiments, corner latching apparatus 22 may comprise markings that indicate a trim line. The illustrated embodiment of FIG. 2A shows trim line 9 on an upper surface of horizontally disposed latching arms 24 and 26. Trim line 9 is labeled "CORNER UNIT" in the illustrated embodiment to indicate the location that the corner latching apparatus 22 may be cut for installation of a corner-shaped curtain wall member, if appropriate (and as described in greater detail below). As an example, horizontally disposed latching arm 24 may be cut along trim line 9 to reduce its length from six inches to three inches, dimensions that are provided for example purposes only. U.S. Imperial scale 7, metric scale 8, and/or trim line 9 may be located on one or more horizontally-disposed latching arms (e.g., horizontally-disposed latching arm 24 and/or horizontally-disposed latching arm 26).

Figure 3:
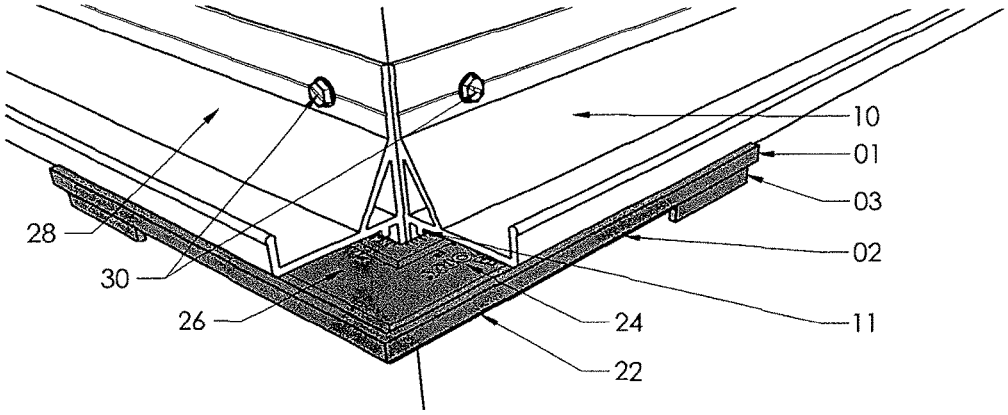
FIG. 3 illustrates a perspective of an example curtain wall system constructed in accordance with certain embodiments of the present disclosure.

FIG. 3 illustrates a perspective view of an example positioning of corner latching apparatus 22 in a curtain wall system 100 constructed in accordance with certain embodiments of the present disclosure. As shown, curtain wall system 100 comprises curtain wall member supporting apparatus 10 and curtain wall member supporting apparatus 28. In certain embodiments, multiple curtain wall member supporting apparatuses (e.g., curtain wall member supporting apparatus 10 and curtain wall member supporting apparatus 28) are secured to a wall of a structure (e.g., a building) such that curtain wall members 140 may be installed using the curtain wall member supporting apparatuses.

Curtain wall member supporting apparatuses (e.g., 10 and 28) may be secured to the wall in any suitable manner, such as by suitable fasteners 30. The number of fasteners 30 for affixing curtain wall member supporting apparatuses to the wall may vary according to a particular application of curtain wall system 100. In certain embodiments, fasteners 30 may be placed at opposite ends of curtain wall supporting channels. Such an arrangement of fasteners 30 may provide strength for dead load requirements as well as resistance to both positive and negative wind load. In certain other embodiments, curtain wall member supporting apparatuses may be secured to a wall using a single fastener 30. The present disclosure contemplates the use of any suitable number of fasteners in affixing curtain wall member supporting apparatuses to a wall. Curtain wall member supporting apparatuses may be formed from any suitable material or combination of materials. In certain embodiments, curtain wall member supporting apparatuses may be fabricated from aluminum. Other materials, however, may be used in the fabrication of curtain wall member supporting apparatuses depending upon the requirements of particular applications of curtain wall system 100.

Curtain wall member supporting apparatuses (e.g., 10 and 28) may be arranged in any suitable manner on a wall. In certain embodiments, multiple curtain wall member supporting apparatuses (e.g., 10 and 28) may be positioned adjacent to one another to define a curtain wall support structure that extends substantially the entire width of a wall. In certain embodiments, the length of a curtain wall member supporting apparatus may extend substantially the entire width of the wall. The curtain wall member supporting apparatuses may be vertically displaced along a wall, such that two rows of curtain wall member supporting apparatuses affixed to the wall can support multiple curtain wall members 140. In certain other embodiments, curtain wall member supporting apparatuses may be positioned at spaced apart locations along the width of the wall and vertically displaced curtain wall member supporting apparatuses may be substantially parallel to one another. The present disclosure contemplates the use of any suitable arrangement of curtain wall member supporting apparatuses.

In the illustrated embodiment of FIG. 3, corner latching apparatus 22 is engaged with curtain wall member supporting apparatus 10 and curtain wall member supporting apparatus 28 that meet at a corner of the wall. As shown, horizontally-disposed latching arm 24 of corner latching apparatus 22 is engaged with curtain wall member supporting apparatus 10 and horizontally-disposed latching arm 26 of corner latching apparatus 22 is engaged with curtain wall member supporting apparatus 28. Details of these engagements will be discussed further in the following figures.

Figure 4A:
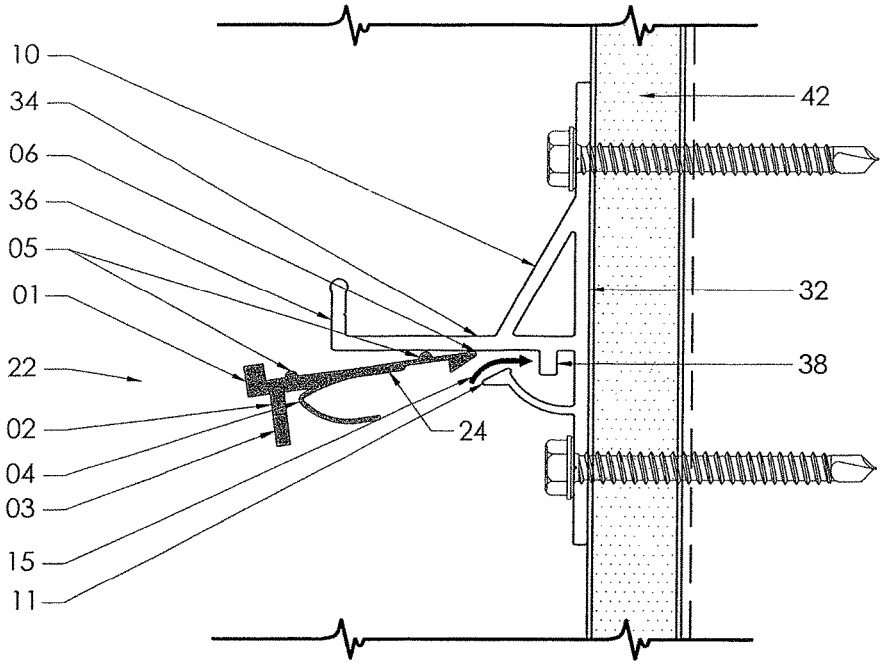
FIGS. 4A and 4B illustrate an example corner curtain wall member latching apparatus installation process in accordance with certain embodiments of the present disclosure.
Figure 4B:
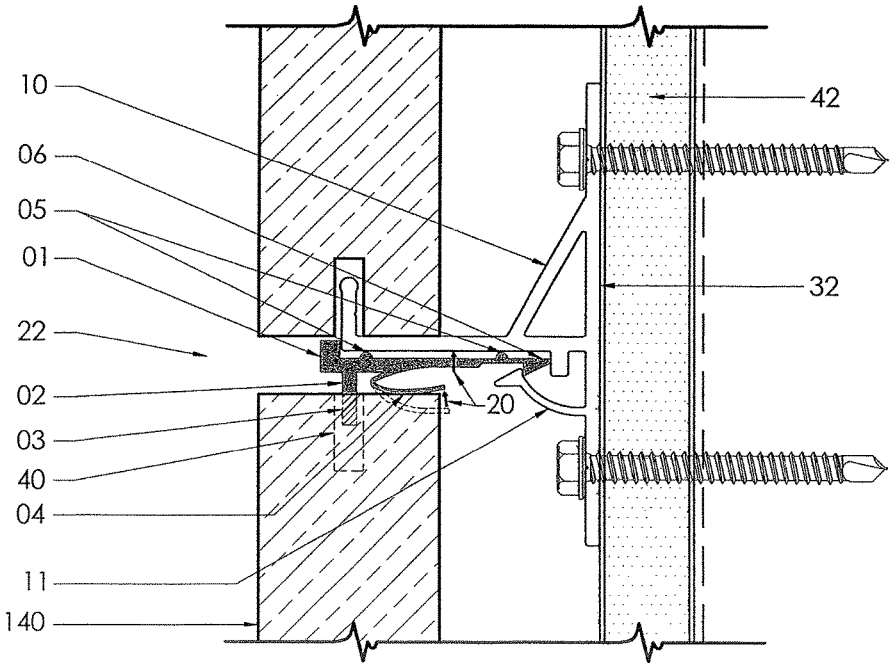

FIGS. 4A and 4B illustrate an example installation process of corner latching apparatus 22 in accordance with certain embodiments of the present disclosure. Particularly, FIG. 4A illustrates a sectional view of corner latching apparatus 22 and curtain wall member supporting apparatus 10 prior to completing installation and FIG. 4B illustrates a sectional view of corner latching apparatus 22 and curtain wall member supporting apparatus 10 after installation is complete. As shown, curtain wall member supporting apparatus 10 comprises vertically-disposed member 32, horizontally-disposed supporting member 34, locking member 11, vertically-disposed locating member 36, and stop 38.

As illustrated in FIGS. 4A and 4B, vertically-disposed member 32 of curtain wall member supporting apparatus 10 is disposed vertically adjacent to wall 42 of a structure to which curtain wall 120 is being mounted. An inner surface of vertically-disposed member 32 may be adapted to rest substantially flush against wall 42, though the present disclosure contemplates there being any suitable intervening components or materials. Vertically-disposed member 32 may be fastened to wall 42 with one or more fasteners 30. Horizontally-disposed supporting member 34, as shown, extends substantially perpendicularly outwardly from wall 42. In certain embodiments, vertically-disposed locating member 36 may be located at and extend substantially perpendicularly upwardly from the distal end of horizontally-disposed supporting member 34. In certain embodiments, curtain wall member supporting apparatus 10 is provided with locking member 11. Locking member 11 may have any suitable size and shape, according to particular needs. In the illustrated embodiments of FIGS. 4A and 4B, the shape of locking member 11 resembles a hook.

Curtain wall member supporting apparatus 10 may also include a stop 38 positioned on the underside of horizontally-disposed supporting member 34 of curtain wall member supporting apparatus 10. In the illustrated embodiment of FIGS. 4A and 4B, stop 38 extends downward from the underside of horizontally-disposed supporting member 34 near the proximal end of horizontally-disposed supporting member 34. In certain embodiments, stop 38 extends downward toward locking member 11.

In certain embodiments, horizontally-disposed latching arm 24 of corner latching apparatus 22 is adapted to engage with curtain wall member supporting apparatus 10. In certain embodiments, connection mechanism 6 of corner latching apparatus 22 rotates into locking member 11 of curtain wall member supporting apparatus 10 during installation. The illustrated embodiment of FIG. 4A shows arrow 15, which represents the direction of rotation as corner latching apparatus 22 rotates into position. FIG. 4B shows the position of corner latching apparatus 22 after corner latching apparatus 22 is locked in place. In certain embodiments, stop 38 prevents connection mechanism 6 of corner latching apparatus 22 from advancing further toward vertically-disposed member 32 of curtain wall member supporting apparatus 10.

In the illustrated embodiment of FIG. 4B, stabilizing resilient member 4 of corner latching apparatus 22 compresses against an upper surface of curtain wall member 140. Arrows 20, as shown in FIG. 4B, represent the movement of stabilizing resilient member 4 as curtain wall member 140 is set in place. The pressure resulting from the compression of stabilizing resilient member 4 assists in aligning corner latching apparatus 22 with curtain wall member supporting apparatus 10. For example, in certain embodiments, as stabilizing resilient member 4 compresses, an upper surface of corner latching apparatus 22 pushes up against a lower surface of curtain wall member supporting apparatus 10, preventing the distal end of corner latching apparatus 22 from sagging. In certain instances, the compression of stabilizing resilient member 4 may also reduce or eliminate warping of corner latching apparatus 22. For purposes of this description, reference to stabilizing resilient member 4 compressing against a curtain wall member 140 contemplates stabilizing resilient member 4 being directly in contact with the curtain wall member 140 or in contact with one or more intervening components between stabilizing resilient member 4 and the curtain wall member 140.

As shown in the illustrated embodiments of FIGS. 4A and 4B, knobs 5 may abut horizontally-disposed supporting member 34 of curtain wall member supporting apparatus 10. Knobs 5 formed on horizontally-disposed latching arm 24 of corner latching apparatus 22 may advantageously help maintain proper alignment between horizontally disposed latching arm 24 and adjacent curtain wall members, horizontally-disposed supporting member 34 of curtain wall member supporting apparatus 10, and/or other structures of curtain wall system 100.

Curtain wall member 140, as shown in FIG. 4B, may be composed of ceramic, stone, glass, aluminum, wood, composite graphite, or any other suitable material or combination of materials. Curtain wall member 140 may include notch 40. Notch 40 may be formed in any suitable manner. For example, notch 40 may be formed along a lower end and an upper end of curtain wall member 140 by saw cutting a horizontal joint into each end. Notches 40 (e.g., kerf joints) in curtain wall member 140 may provide a mechanism for an installer to position a component on curtain wall member 140. For example, an installer may mount corner latching apparatus 22 onto curtain wall member 140 prior to engaging corner latching apparatus 22 with curtain wall member supporting apparatus 10. In certain embodiments, components of curtain wall system 100 may be secured in notches 40 of curtain wall member 140 by an adhesive. For example, a joint sealant (e.g., silicone) may be placed in notch 40 prior to placing corner latching apparatus 22 into notch 40 of curtain wall member 140.

As shown in the illustrated embodiments of FIGS. 4A and 4B, curtain wall 120 may include any suitable combination of plywood, steel or wood studs, concrete masonry units (CMOs), concrete, or any other suitable material. Other construction techniques may be used in the fabrication of curtain wall 120 depending upon the requirements of particular applications of the present disclosure. In certain embodiments, wall 120 may be an exterior or interior wall 42 of a building or other structure. In certain embodiments, wall 42 may be provided with a weather proof exterior layer, which may be fabricated using any suitable technique. As an example, weather proof exterior layer may be self-sealing tape.

Figure 5A:
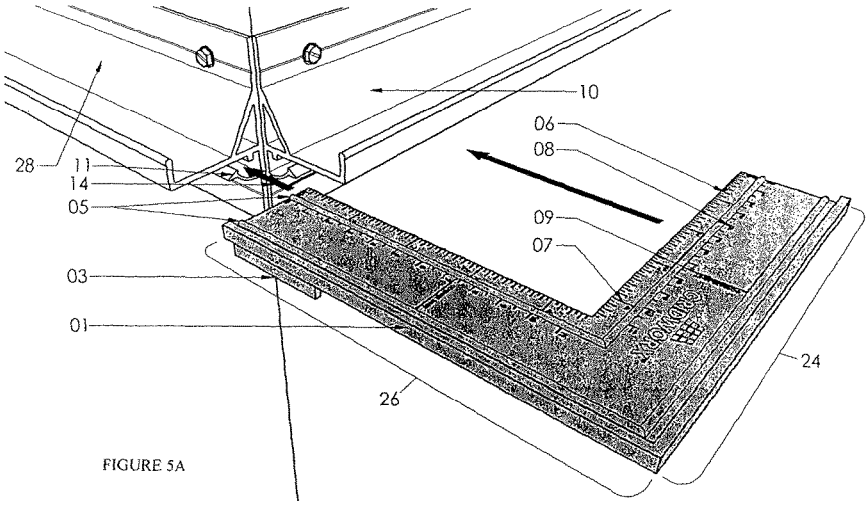
FIGS. 5A and 5B illustrate perspectives of an example corner curtain wall member latching apparatus installation process in accordance with certain embodiments of the present disclosure.
Figure 5B:
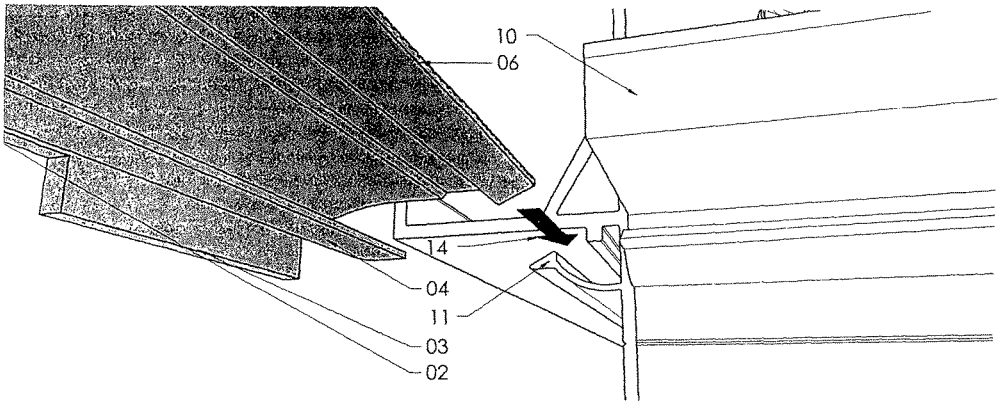

FIGS. 5A and 5B illustrate perspective views of an example installation process of corner latching apparatus 22 in accordance with certain embodiments of the present disclosure. As shown in FIG. 5A, corner latching apparatus 22 is adapted to engage with curtain wall member supporting apparatuses 10 and 28. In this example, horizontally-disposed latching arm 24 of corner latching apparatus 22 is adapted to engage with curtain wall member supporting apparatus 10, and horizontally-disposed latching arm 26 of corner latching apparatus 22 is adapted to engage with curtain wall member supporting apparatus 28.

Horizontally-disposed latching arm 26, as shown in the illustrated embodiments of FIGS. 5A and 5B, is adapted to slide into locking member 11 of curtain wall member supporting apparatus 28. For example, connection mechanism 6 of horizontally-disposed latching arm 26 is adapted to slide within a space between locking member 11 and stop 38 of curtain wall member supporting apparatus 28. Once corner latching apparatus 22 has been slid into position, engagement of connection mechanism 6 with locking member 11 may facilitate prevention of removal of corner latching apparatus from curtain wall member supporting apparatus 28 in a direction orthogonal to the wall on which curtain wall member supporting apparatus 28 is mounted. Compression of stabilizing resilient member 4 by a curtain wall member 140 may further facilitate maintaining corner latching apparatus 22 in position such that connection mechanism 6 of corner latching apparatus 22 is engaged with locking member 11 of curtain wall member supporting apparatus 28.

In certain embodiments, horizontally-disposed latching arm 24 is adapted to rotationally engage with locking member 11 of curtain wall member supporting apparatus 10. In some instances, further inward movement of corner latching apparatus 22 is prevented by engagement of connection mechanism 6 of corner latching apparatus 22 with stop 38 of curtain wall member supporting apparatus 10.

Figure 6:
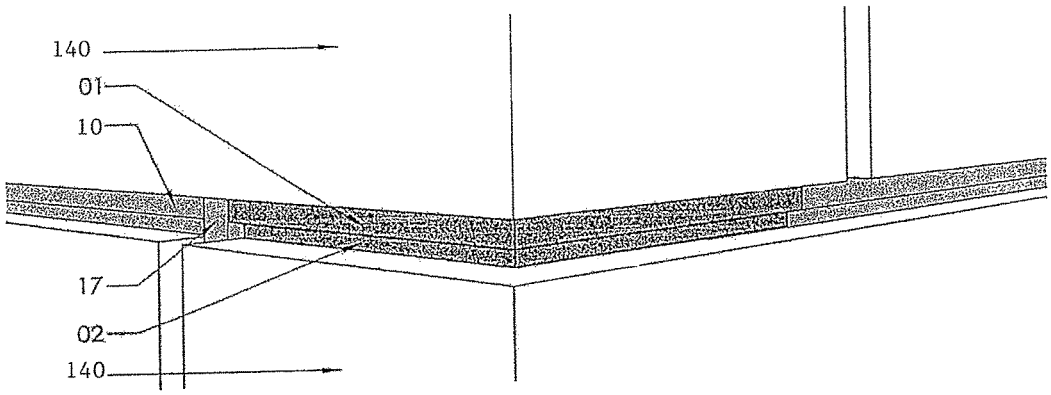
FIG. 6 illustrates an additional perspective of an example corner curtain wall member latching apparatus installed in a curtain wall system in accordance with certain embodiments of the present disclosure.

FIG. 6 illustrates an additional perspective of an example corner latching apparatus 22 installed in curtain wall system 100 in accordance with certain embodiments of the present disclosure. As shown in FIG. 6, a waterblocker 17 may be located between corner latching apparatus 22 and curtain wall member supporting apparatus 10. The dimensions of the various components of curtain wall system 100 may vary according to particular applications. The present disclosure contemplates that the various components of curtain wall system 100 may have any suitable dimensions. In certain embodiments, the dimensions of the various components of curtain wall system 100 may be different from those illustrated in FIGS. 1 through 6. Also, the present disclosure contemplates the addition of any further structural supporting elements throughout the system.

Figure 7:
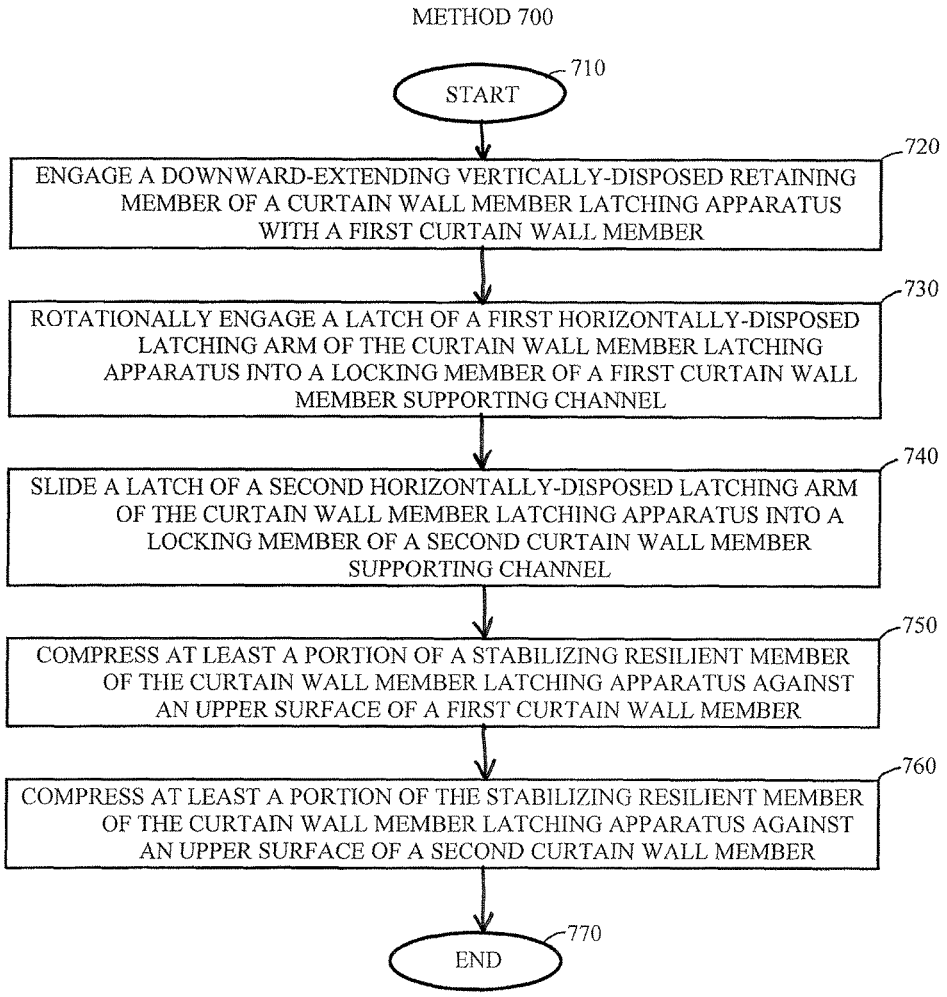
FIG. 7 illustrates a method of installing an example corner curtain wall member latching apparatus in accordance with certain embodiments of the present disclosure.

FIG. 7 illustrates an example method of installing corner latching apparatus 22 in accordance with certain embodiments of the present disclosure. Method 700 starts at step 710. At step 720, downward-extending vertically-disposed retaining member 3 of a corner latching apparatus 22 engages with curtain wall member 140*a*. For example, downward-extending vertically-disposed retaining member 3 of a corner latching apparatus 22 may be placed within a kerf of curtain wall member 140*a* prior to engaging corner latching apparatus 22 with curtain wall member supporting apparatuses 10 and 28.

At step 730, connection mechanism 6 (e.g., a latch) of horizontally-disposed latching arm 24 of corner latching apparatus 22 rotationally engages into locking member 11 of curtain wall member supporting apparatus 10. In certain embodiments, an upper surface of horizontally-disposed latching arm 24 slides against an underside of curtain wall member supporting apparatus 10 as connection mechanism 6 of corner latching apparatus 22 rotationally engages into locking member 11 of curtain wall member supporting apparatus 10. One or more knobs 5 of corner latching apparatus 22 may abut an underside of curtain wall member supporting apparatus 10 during installation. In certain embodiments, knobs 5 may advantageously maintain proper alignment between horizontally-disposed latching arm 24 of corner latching apparatus 22 and the horizontally-disposed supporting member of curtain wall member supporting apparatus 10. In certain embodiments, connection mechanism 6 of horizontally-disposed latching arm 24 may contact stop 38 of curtain wall member supporting apparatus 10.

At step 740, connection mechanism 6 of horizontally-disposed latching arm 26 of corner latching apparatus 22 slides into locking member 11 of curtain wall member supporting apparatus 28. In certain embodiments, an upper surface of horizontally-disposed latching arm 26 slides against an underside of curtain wall member supporting apparatus 28 as horizontally-disposed latching arm 26 is slid into locking member 11. For example, one or more knobs 5 of horizontally-disposed latching arm 26 may abut an underside of curtain wall member supporting apparatus 28. In certain embodiments, knobs 5 may advantageously maintain proper alignment between horizontally-disposed latching arm 26 and horizontally-disposed supporting member 34 of curtain wall member supporting apparatus 28.

In some instances, corner latching apparatus 22 slides into locking member 11 of curtain wall member supporting apparatus 28 as horizontally-disposed latching arm 24 of corner latching apparatus 22 rotationally engages into locking member 11 of curtain wall member supporting apparatus 10. In other instances, corner latching apparatus 22 may slide into locking member 11 of curtain wall member supporting apparatus 28 after horizontally-disposed latching arm 24 of corner latching apparatus 22 rotationally engages into locking member 11 of curtain wall member supporting apparatus 28. Alternatively, corner latching apparatus 22 may slide into locking member 11 of curtain wall member supporting apparatus 28 before horizontally-disposed latching arm 24 of corner latching apparatus 22 rotationally engages into locking member 11 of curtain wall member supporting apparatus 28.

Method 700 then moves to step 750. At step 750, at least a portion of stabilizing resilient member 4 of corner latching apparatus 22 compresses against an upper surface of curtain wall member 140*a*. Curtain wall member 140*a* may comprise a notch along its top and bottom surface. In certain embodiments, curtain wall member 140*a* is placed on vertically-disposed locating member 36 of curtain wall member supporting apparatus 10 during installation such that vertically-disposed locating member 36 is located within notch 40 of curtain wall member 140*a*. Corner latching apparatus 22 is placed in notch 40 along a top surface of curtain wall member 140*a*, and horizontally-disposed latching arm 24 of corner latching apparatus 22 rotationally engages into curtain wall member supporting apparatus 10. As corner latching apparatus 22 rotates into place, a pressure is created against a top and bottom surface of curtain wall member 140*a*, causing at least a portion of stabilizing resilient member 4 of corner latching apparatus 22 to compress against a top surface of first curtain wall member 140*a*. The compression of stabilizing resilient member 4 may be used to align corner latching apparatus 22 with curtain wall member supporting apparatus 10 and may help prevent corner latching apparatus 22 from sagging.

At step 760, at least a portion of stabilizing resilient member 4 of corner latching apparatus 22 compresses against an upper surface of curtain wall member 140*b*. In certain embodiments, at step 760, corner latching apparatus 22 is engaged with curtain wall member supporting apparatuses 10 and 28, and curtain wall member 140*a* has already been installed. Curtain wall member 140*b* may comprise a notch (e.g., notch 40) along its bottom surface, which may be placed on a vertically-disposed locating member (e.g., vertically-disposed locating member 36) of a curtain wall member supporting apparatus during installation. As curtain wall member 140*b* rotates into place, a pressure is created against the top and bottom surfaces of curtain wall member 140*b*, causing at least a portion of stabilizing resilient member 4 of corner latching apparatus 22 to compress against a top surface of curtain wall member 140*b*. The compression of stabilizing resilient member 4 may be used to align corner latching apparatus 22 with curtain wall member supporting apparatus 28 and may help prevent corner latching apparatus 22 from sagging. Method 700 ends at step 760.

Although the present disclosure describes or illustrates particular steps as occurring in a particular order, the present disclosure contemplates the steps being performed in any suitable order. Moreover, the present disclosure contemplates any suitable steps being repeated one or more times in any suitable order. Although the present disclosure describes or illustrates particular steps as occurring in sequence, the present disclosure contemplates any suitable steps occurring at substantially the same time, where appropriate.

Particular embodiments of the present disclosure may provide one or more technical advantages. For example, it may be desirable to provide support for a curtain wall member 140 (e.g., stone) at or around the corner of a structure. Certain embodiments of the present disclosure may provide a corner curtain wall member latching apparatus 22 (e.g., a corner L-shaped bracket) that is adapted to engage with two horizontally-disposed supporting members (e.g., 10 and 28), allowing an installer of the curtain wall system 10 to affix one or more curtain wall members 140 around a corner of a structure in an improved manner. The corner latching apparatus 22 may reduce or eliminate the need for installers of a curtain wall system 10 to construct a corner support member from one or more L-shaped brackets.

In another example, it may be desirable for a single installer of a curtain wall system 10 to assemble curtain wall members 140 (e.g., stone) around the corner of a structure without the assistance of other installers. Certain embodiments of the present disclosure may assist the installer in supporting a curtain wall member 140 while the installer assembles an adjoining curtain wall member 140 by providing a vertically-disposed retaining member 3 extending downward from a lower surface of a corner curtain wall member latching apparatus 22 (e.g., a corner L-shaped bracket) that partially engages with a notch 40 (e.g., a kerf) in the curtain wall member 140 (e.g., stone). The vertically-disposed retaining member 3 may be used as an installation tool that allows the curtain wall member 140 to rest in place while the installer erects the adjoining curtain wall member 140. Such an approach may allow the installation process to proceed more quickly and/or efficiently. Additionally, certain embodiments of the present disclosure may provide a stabilizing resilient member 4 that is adapted to compress against an upper surface of a curtain wall member 140 once the corner curtain wall member latching apparatus 22 (e.g., a corner L-shaped bracket) is in place. The pressure exerted against the stabilizing resilient member 140 may reduce or eliminate sagging of the corner curtain wall member latching apparatus 22 (e.g., a corner L-shaped bracket) and may create a substantially even pressure along the upper surface of the latching apparatus 22, preventing the latching apparatus 22 from twisting and/or warping.

It may be desirable to measure curtain wall members 140 in the field during installation. In certain embodiments of the present disclosure, an upper surface of a corner curtain wall member latching apparatus 22 (e.g., a corner L-shaped bracket) comprises a measuring scale that may assist an installer with field modifications. For example, the installer may measure how many inches to cut off the end of a curtain wall member 140 (e.g., stone) so that it abuts an adjacent curtain wall member 140.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims. For example, horizontally-disposed latching arm 24 of corner latching apparatus 22 may slide into locking member 11 of curtain wall member supporting apparatus 10 and horizontally-disposed latching arm 26 of corner latching apparatus 22 may rotationally engage with locking member 11 of curtain wall member supporting apparatus 28.

Use of directional terms such as horizontal, vertical, upward, downward and the like are used for ease of description only. The present description contemplates the components of curtain wall system being oriented in different directions than those described, according to particular needs. As just one example, the components of curtain wall system 100 may be flipped such that components described as extending upward extend downward and components described as extending downward extend upward.

Although the figures and accompanying description may describe a curtain wall system in accordance with certain embodiments of the present disclosure that is oriented in a particular direction, the present disclosure contemplates that the orientation of the curtain wall system and its various components may be varied in any suitable manner. As an example, the described supporting structures may be modified such that the orientation of the curtain wall system is substantially flipped.

What is claimed is:

1. A curtain wall system, comprising:

a first curtain wall member supporting apparatus and a second curtain wall member supporting apparatus each having a respective:

vertically-disposed member;

horizontally-disposed supporting member; and locking member coupled to the vertically-disposed member, wherein the locking member is disposed beneath a lower surface of the horizontally-disposed supporting member; and a corner curtain wall member latching apparatus having a corner shape and comprising:

a first horizontally-disposed latching arm oriented in a first direction and adapted to engage with the locking member of the first curtain wall member supporting apparatus;

a second horizontally-disposed latching arm oriented in a second direction;

a stabilizing resilient member disposed beneath a lower surface of each of the first and second horizontally-disposed latching arms, at least a portion of the stabilizing resilient member adapted to compress against an upper surface of a curtain wall member;

a latch at a first end of each of the first and second horizontally-disposed latching arms, the latch of the first horizontally-disposed latching arm adapted to slide into the locking member of the first curtain wall member supporting apparatus;

a vertically-disposed locating member extending vertically from the lower surface of each of the first and second horizontally-disposed latching arms; and a vertically-disposed retaining member, wherein the vertically disposed retaining member:

extends vertically from the vertically-disposed locating member of the first horizontally-disposed latching arm;

extends partially along the vertically-disposed locating member of the first horizontally-disposed latching arm such that the vertically-disposed retaining member extends less than a full length of the vertically-disposed locating member; and is adapted to engage with a notch in the curtain wall member.

2. The system of claim 1, wherein the latch of the second horizontally-disposed latching arm is adapted to engage with the locking member of the second curtain wall member supporting apparatus.

3. The system of claim 1, wherein the stabilizing resilient member is located between the vertically-disposed locating member and the latch of each of the first and second horizontally-disposed latching arms.

4. The system of claim 1, wherein the corner curtain wall member latching apparatus further comprises a vertically-disposed locating member extending from a second end of each of the first and second horizontally-disposed latching arms.

5. The system of claim 1, wherein the corner shape of the corner curtain wall member latching apparatus forms a 90 degree angle.

6. A curtain wall system, comprising:

a first curtain wall member supporting apparatus and a second curtain wall member supporting apparatus; and a corner curtain wall member latching apparatus having a corner shape and comprising:

a first horizontally-disposed latching arm oriented in a first direction and adapted to engage with the first curtain wall member supporting apparatus;

a second horizontally-disposed latching arm oriented in a second direction; and a stabilizing resilient member disposed beneath a lower surface of each of the first and second horizontally-disposed latching arms, at least a portion of the stabilizing resilient member adapted to compress against an upper surface of a curtain wall member member;

a latch at a first end of each of the first and second horizontally-disposed latching arms, the latch of the first horizontally-disposed latching arm adapted to slide into a locking member of the first curtain wall member supporting apparatus, wherein the locking member of the first curtain wall member supporting apparatus is disposed beneath a lower surface of a horizontally-disposed supporting member of the first curtain wall member supporting apparatus;

a vertically-disposed locating member extending vertically from the lower surface of each of the first and second horizontally-disposed latching arms; and a vertically-disposed retaining member, wherein the vertically disposed retaining member:

extends vertically from the vertically-disposed locating member of the first horizontally-disposed latching arm;

extends partially along the vertically-disposed locating member of the first horizontally-disposed latching arm such that the vertically-disposed retaining member extends less than a full length of the vertically-disposed locating member; and is adapted to engage with a notch in the curtain wall member.

7. The system of claim 6, wherein the second horizontally-disposed latching arm of the corner curtain wall member latching apparatus is adapted to rotationally engage with a locking member of the second curtain wall member supporting apparatus.

8. A method, comprising:

engaging a corner curtain wall member latching apparatus with a locking member of a first curtain wall member supporting apparatus, wherein the corner curtain wall member latching apparatus has a corner shape and comprises:

a first horizontally-disposed latching arm oriented in a first direction;

a second horizontally-disposed latching arm oriented in a second direction;

a stabilizing resilient member, the stabilizing resilient member disposed beneath a lower surface of each of the first and second horizontally-disposed latching arms, at least a portion of the stabilizing resilient member adapted to compress against an upper surface of a first curtain wall member;

a latch at a first end of each of the first and second horizontally-disposed latching arms, the latch of the first horizontally-disposed latching arm adapted to slide into the locking member of the first curtain wall member supporting apparatus, wherein the locking member of the first curtain wall member supporting apparatus is disposed beneath a lower surface of a horizontally-disposed supporting member of the first curtain wall member supporting apparatus;

a first vertically-disposed locating member extending vertically from the lower surface of each of the first and second horizontally-disposed latching arms; and a vertically-disposed retaining member, wherein the vertically disposed retaining member:

extends vertically from the first vertically-disposed locating member of the first horizontally-disposed latching arm;

extends partially along the first vertically-disposed locating member of the first horizontally-disposed latching arm such that the vertically-disposed retaining member extends less than a full length of the first vertically-disposed locating member; and is adapted to engage with a notch in the first curtain wall member; and compressing the at least a portion of the stabilizing resilient member of the corner curtain wall member latching apparatus against the upper surface of the first curtain wall member.

9. The method of claim 8, wherein engaging the corner curtain wall member latching apparatus with the locking member of the first curtain wall member supporting apparatus comprises sliding the latch of the first horizontally-disposed latching arm of the corner curtain wall member latching apparatus into the locking member of the first curtain wall member supporting apparatus.

10. The method of claim 9, further comprising engaging a downward-extending vertically-disposed retaining member of the corner curtain wall member latching apparatus with the first curtain wall member prior to sliding the latch of the first horizontally-disposed latching arm into the locking member of the first curtain wall member supporting apparatus.

11. The method of claim 8, further comprising rotationally engaging a latch of the second horizontally-disposed latching arm of the corner curtain wall member latching apparatus with a locking member of a second curtain wall member supporting apparatus, wherein the locking member of the second curtain wall member supporting apparatus is disposed beneath a lower surface of a horizontally-disposed supporting member of the second curtain wall member supporting apparatus.

12. The method of claim 11, further comprising engaging a downward-extending vertically-disposed retaining member of the corner curtain wall member latching apparatus with the first curtain wall member prior to rotationally engaging the latch of the second horizontally-disposed latching arm into the locking member of the second curtain wall member supporting apparatus.

13. The method of claim 8, further comprising compressing at least a portion of the stabilizing resilient member of the corner curtain wall member latching apparatus against an upper surface of a second curtain wall member after compressing the at least a portion of the stabilizing resilient member against the upper surface of the first curtain wall member.

14. The method of claim 8, wherein the corner curtain wall member latching apparatus further comprises a second vertically-disposed locating member extending upward from an end of each of the first and second horizontally-disposed latching arms.

15. The method of claim 8, wherein the corner shape of the corner curtain wall member latching apparatus forms a 90 degree angle.

* * * * *